United States Patent [19]

Henson

[11] Patent Number: 4,972,905

[45] Date of Patent: Nov. 27, 1990

[54] RELEASABLE AIR VENT PIPE FOR USE ON WATER WELL COVERS

[76] Inventor: Fairl G. Henson, Federal Building, Grants Pass, Oreg. 97526

[21] Appl. No.: 408,914

[22] Filed: Sep. 18, 1989

[51] Int. Cl.[5] ..... E21B 17/02

[52] U.S. Cl. ..... 166/92; 138/89

[58] Field of Search ..... 166/92, 93, 94, 97; 138/89; 285/382.7, 220; 52/169.5, 169.6

[56] References Cited

U.S. PATENT DOCUMENTS 830,782 9/1906 Gray ..... 166/93
3,917,292 11/1975 Martin ..... 277/110
3,963,054 6/1976 Martin ..... 138/89
3,998,245 12/1976 Martin ..... 138/89
4,124,235 11/1978 Grahl et al. ..... 285/382.7 X

*Primary Examiner*—William P. Neuder

[57] ABSTRACT

An air ventilation pipe for a well casing cover is comprised of a cylindrical externally screw-threaded socket which has a cylindrical externally screw-threaded portion projecting downwardly through the aperture in a well casing cover. An enlarged head at its inner part for the engagement of a wrench. A nut for securing a cylindrical tube within the socket. The socket and nut compress between them a metallic deformable ring into sealing relationship with the cylindrical tube.

2 Claims, 1 Drawing Sheet

RELEASABLE AIR VENT PIPE FOR USE ON WATER WELL COVERS

BACKGROUND OF THE INVENTION

This invention relates to a air vent pipe for well casing covers which is quickly and easily secured to the well casing cover.

When wells, such as for obtaining water, are drilled, cylindrical tubing in the form of steel pipe is inserted into the resulting well shaft to serve as the side walls of the well. Typically a short portion of this casing extends out of the ground as the upper terminal of the well, which must be covered to prevent foreign matter from entering the well. A water well cover generally provides this security and also provides provisions for passing tube and electrical wire to a pump which is submerged in the well. Inaddition, the well cover must provide provisions for an air ventilation pipe.

At the present time air ventilation pipes are ordinary cylindrical tubes screwed into apertures of well casing covers. The cylindrical tubes may have downwardly pointing terminal ends or may have caps secured to the terminal end.

The rotation of the air ventilation pipe in congested space above the well cover is an objection in conventional cases. There is a great loss in time required to make a installation by the above described method where the installation is in a relatively open space and manipulation is easy, and this loss is magnified many times where the tubes and pump controls may be close together and in relatively inaccessible places, as frequently occurs. Heretofore air ventilation pipes, such as those previously discussed are difficult to install and remove.

It is an object of the present invention to eliminate the laborious procedure of installing air ventilation pipes in congested spaces on well covers and to install air ventilation pipes in only a fraction of the time heretofore required.

SUMMARY OF THE INVENTION

The air ventilation device of the present invention comprises a cylindrical tube which has a downwardly pointing bend at the upper terminal. A compression coupling attached to the lower terminal of the cylindrical tube, so as to provide a fixture which secures the cylindrical tube to a threaded aperture in a well casing cover.

It is accordingly an object of the present invention to provide an improved air ventilation method which is easily carried out and an improved air ventilation device which is economical in construction.

It is a further object of the present invention to provide an improved air ventilation method and device which permits a somewhat flexible joint in order to position the cylindrical tube in a congested location.

The foregoing objectives, features and advantages of the present invention will be more readily understood upon consideration of the following detailed description of the invention taken in conjunction with the accompanying drawings.

DETAILED DESCRIPTION OF THE INVENTION

Figure 1:
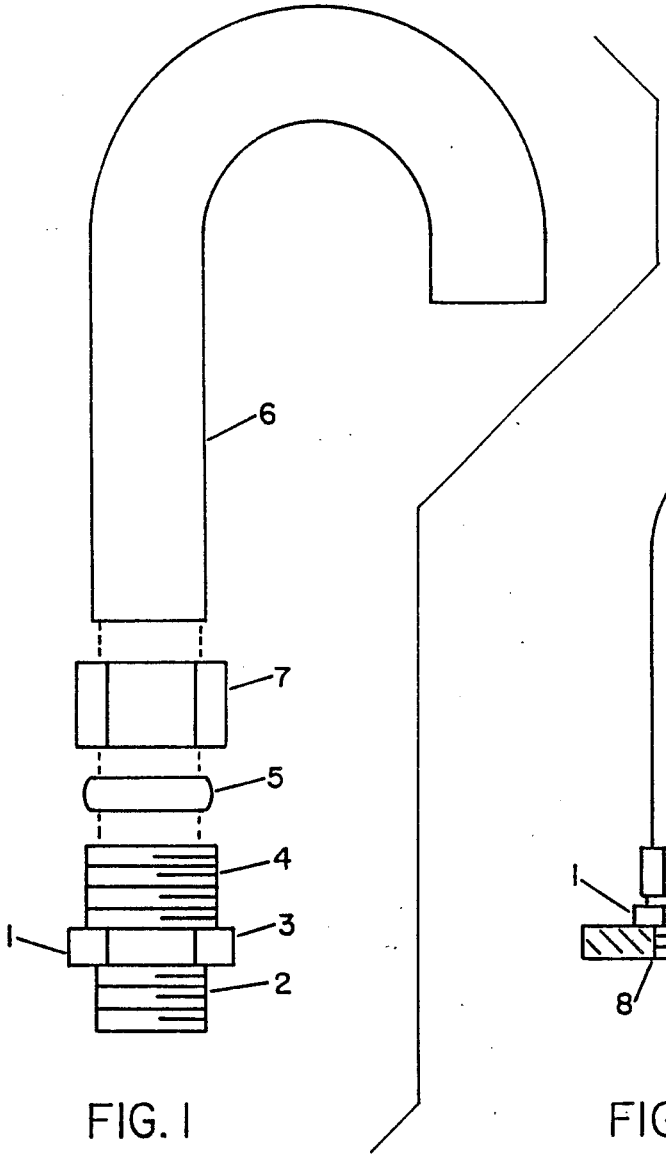
FIG. 1 is an exploded view showing a preferred embodiment of the air ventilation device of the present invention.

Referring to the drawing, the air ventilation device of the present invention includes a cylindrical tube 6 which is configured to fit the upper socket 4 of tube 1. Tube 1 includes an enlarged head 3 of a diameter greater than the cylindrical externally screw-threaded portions 2 and 4. The enlarged head 3 is merely used in this form of invention for engagement by wrench jaws to screw the lower portion of tube 1 into a threaded aperture 8 in a well casing cover 9.

The interior surface of tube 1 comprises an upper cylindrical socket 4 extending from the upper end of socket 4 and terminating at its rear or inner end in a radially inwardly extending annulary shoulder on the inner end of the socket 4. The exterior cylindrical surface 6 is in contact with all of interior surface of socket 4 and extends a distances downward of the upper end of socket 4.

Figure 2:
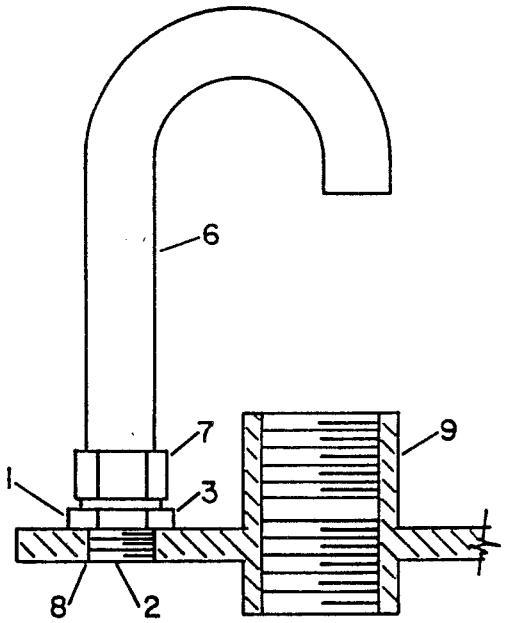
FIG. 2 is a fragmentary sectional view of a well cover showing the installation of the air ventilation device.

Thus, when nut 7 is screwed down upon socket 4, the inner end of nut 7 will eventually abut with ring 5. Upon such contact, socket 4 will be drawn upward and sealing ring 5 will be compressed into sealing relationship. The ring 5 is of an inside diameter greater than the greatest outside diameter of cylindrical tube 6 and is of an outside diameter the same as socket 4. A very important feature of the invention comprises the provision of means for positioning the cylindrical tube 6 and in the illustrated embodiment this means takes the form of a somewhat flexible joint as seen in FIGS. 1 and 2.

Although the present inventon has been described in connection with preferred embodiments, it is to be understood that modifications and variations may be resorted to without departing from the spirit or scope of the invention, as those skilled in this art will readily understand. Such modifications and variations are considered to be within the purview and scope of the invention as defined by the appended claims.

What is claimed is:

1. An air vent pipe for use in a well casing cover comprising:

(a) a well casing cover having a threaded aperture therein;

(b) a cylindrical tube having an enlarged head portion;

(c) said cylindrical tube having a threaded portion below the enlarged head, said threaded portion being screwed into said threaded aperture by means engaging said enlarged head portion;

(d) said cylindrical tube having a threaded portion above said enlarged head, said upper threaded portion receiving said air vent pipe;

(e) a nut, through which said air vent pipe passes, being adapted to thread onto said upper threaded portion;

(f) a metallic deformable sealing ring which is deformed into sealing engagement with said air vent pipe when said nut is threaded onto said upper threaded portion; and (g) said air vent pipe having an upper inverted u-shaped semi-circular portion, said sealing ring and said nut cooperates with said vent pipe to secure said vent pipe to said well casing cover in a manner allowing said vent pipe to be readily rotatably adjustable so that said inverted u-shaped portion of said vent pipe is easily rotated to a more convenient position.

2. An air vent pipe for use in a well casing cover as claimed in claim 1, wherein said air vent pipe is made from a material which is less readily deformable than said sealing ring, the air ventpipe being disposed between the sealing ring and a shoulder on the nut, the friction between the pipe and the sealing ring being greater than the friction between the pipe and the nut.

* * * * *